United States Patent [19]

Roberts

[11] 4,139,841

[45] Feb. 13, 1979

[54] ELECTROMAGNETIC INFORMATION DISPLAY SYSTEM

[75] Inventor: Charles E. Roberts, Norristown, Pa.

[73] Assignee: E-Systems, Inc., Dallas, Tex.

[21] Appl. No.: 808,998

[22] Filed: Jun. 22, 1977

[51] Int. Cl.[2] ..... G08B 5/22

[52] U.S. Cl. ..... 340/373; 340/381; 340/703

[58] Field of Search ..... 340/378, 373, 166 R, 340/381, 336

[56] References Cited

U.S. PATENT DOCUMENTS

| | | | |
|---|---|---|---|
| 3,210,757 | 10/1965 | Jacob | 340/373 |
| 3,267,455 | 8/1966 | McGuire | 340/373 |
| 3,322,482 | 5/1967 | Harmon | 340/373 X |
| 3,827,048 | 7/1974 | Usui | 340/166 R |

*Primary Examiner*—Harold I. Pitts
*Attorney, Agent, or Firm*—Robert V. Wilder

[57] ABSTRACT

A selected message is displayed by an electromagnetic information display system having a matrix of display openings formed through a display board for receiving therein a plurality of solenoid coils. Magnetic display elements are disposed within each of the solenoid coils. The magnetic display elements have permanently magnetized poles located at opposite ends thereof and further have contrastingly colored surfaces associated with the magnetic poles. The solenoid coils are electrically interconnected for selectively inducing a magnetic field within any of the coils for aligning the display elements. A plurality of drivers are connected on an individual basis to one lead of all coils positioned within a column to output a ground or reference voltage as determined by the input of the driver. A set of digital strobes applies an output voltage one-half that of the reference voltage to the opposite lead of the solenoid coils positioned within a row for determining the direction of the magnetic field within the coils. A ferromagnetic back plate latches the display elements into the alignment determined by the direction of the magnetic field.

3 Claims, 7 Drawing Figures

ELECTROMAGNETIC INFORMATION DISPLAY SYSTEM

FIELD OF THE INVENTION

The present invention relates to an informational display system, and more particularly to an electromagnetic information display system having display elements that are rotatable to visually indicate the desired information.

DESCRIPTION OF THE PRIOR ART

Prior art electromagnetic information display systems have utilized contrastingly colored permanently magnetized spheres for rotation controlled by solenoid coils arranged in a matrix of a display board. U.S. Pat. Nos. 3,036,300 and 3,267,455 are examples of the two such prior art display devices. In the former patent, a solenoid coil is located directly behind each magnetic sphere which is pivoted for rotation, while in the latter patent the magnetic display element is first rotated to a transitional state before it is oriented in either one of its stable states.

The electromagnetic information display systems described above and other prior art display systems utilizing a solenoid coil to align a permanently magnetized display element have proven unsatisfactory because of certain structural and economical limitations of such systems. The prior art circuitry for individually controlling an array of closely situated solenoid coils is cumbersome to assemble and consumes an inordinate amount of space, even in small arrays. Such devices do not have means for latching the display elements into alignment without adding to the complexity and size of the system. In addition, the expense associated with the assembly and interconnection of solenoid coils in such devices has limited their practical uses. Further, such systems often waste electrical energy by consuming energy while the system is in the quiescent state.

Thus, a need has arisen for an electromagnetic information display system that overcomes these and other disadvantages associated with the prior art.

SUMMARY OF THE INVENTION

The information display system of the present invention has an improved structure for the assembly and electrical interconnection of a matrix of solenoid coils, and includes a set of digital drivers for driving the coils from digital logic signals. A ferromagnetic back plate is provided to latch the display elements into position. Thus, the display system of the present invention is capable of displaying information without consuming any quiescent power, so that the information displayed will not be lost in any particular instant if the system loses power. Further, the display system of the present invention is compact in size and economical to assemble.

In accordance with the present invention, a plurality of rotatable display elements have permanently magnetized poles located at opposite ends thereof and further have contrastingly colored surfaces associated with the magnetic poles. An information display board has a thickness equal to or greater than the diameter of the display elements and includes a plurality of openings formed completely therethrough and arranged in a matrix of a predetermined number of columns and rows. A solenoid coil is disposed within each of the openings for receiving therein the display elements. The system includes means for electrically interconnecting a lead of all coils positioned within a column and means for electrically interconnecting the opposite leads of all coils positioned within a row. Means are provided for selectively inducing a directional magnetic field within the coils for aligning the contrastingly colored surfaces of the display elements for the display of information. The display elements may be latched into position in the alignment determined by the direction of the magnetic field. A cover panel extends across the front of the display for retaining the display elements within the board and providing a view of the arranged pattern display elements.

In accordance with another feature of the invention, a display board is a printed circuit board and the solenoid coils are electrically interconnected by printed circuit tracks deposited on the front and rear surfaces of the circuit board. The display elements may be latched into their aligned position by a ferromagnetic back plate, and an insulation panel is provided to extend between the back plate and reverse side of the display board for electrically insulating the printed electrical conductors from the back plate.

In accordance with yet another feature of the invention, a first set of drivers is provided to connect one lead of all coils positioned within a column to a ground or reference voltage outputted in response to the digital logical input state of the drivers. A set of digital strobes is provided for strobing the opposite lead of all solenoid coils positioned and interconnected within a row with a voltage one-half that of the reference voltage, such that a current may be made to selectively flow in either direction through any of said coils for alternating the magnetic field produced within the coils and thus aligning the display elements therein.

In connection with another feature of the invention, an improved method is disclosed for forming the solenoid coil to be positioned in each hole of a matrix of display holes of a printed circuit board. The printed circuit board has a thickness greater than the diameter of the magnetic display elements received therein, and each display hole opens to the front and rear surfaces of the circuit board. An electrical conductor is printed on the front and rear surface of the display board for electrically interconnecting columns and rows of the matrix of display holes. The display hole is formed through the circuit board and plated with an electrical conductor. A solenoid coil is formed within each hole by cutting internal threads through the plated display holes.

DESCRIPTION OF THE DRAWINGS

For a more complete understanding of the present invention and further advantages thereof, reference is now made to the following description taken in conjunction with the following drawings.

DESCRIPTION OF THE PREFERRED EMBODIMENT

Figure 1:
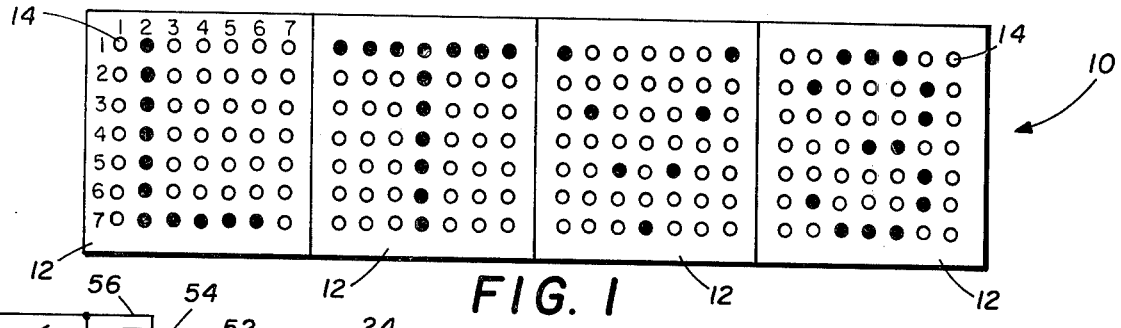
FIG. 1 is a perspective view of the preferred embodiment of the invention.

FIG. 1 illustrates an alpha-numeric display of information on the electromagnetic information system of the present invention, generally indicated by the reference numeral 10. The particular information display system 10 illustrated includes four serially arranged display boards 12. The information display system 10 of the present invention may consist of course of any number or arrangement of individual display boards 12. The display boards 12 contain a 7 × 7 matrix of magnetic display elements 14, such that each of the display elements 14 may be rotated so that its surface is either identical to or contrasts with the color of the front side of the display board 12. Information is thereby visually displayed on the display board 12. The display boards 12 may comprise any number of magnetic display elements 14 and, of course, are not limited to the 7 × 7 matrix shown in FIG. 1.

Figure 2:
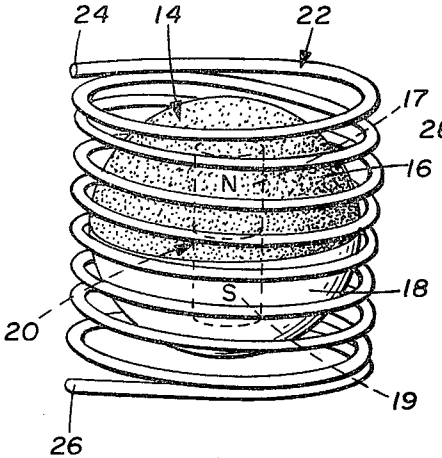
FIG. 2 is a perspective view of a magnetic display element within a solenoid coil.

FIG. 2 illustrates a typical magnetic display element 14 which is spherical in shape and has contrastingly colored hemispherical surfaces 16 and 18. The display element 14 may be formed in other geometrical shapes without departing from the practice of the present invention. A permanent bar magnetic 20 is located within the display element 14 such that its north magnetic pole 17 corresponds to the hemispherical surface 16, while its south magnetic pole 19 corresponds to the hemispherical surface 18.

Surrounding the magnetic display element 14 is a typical solenoid coil 22 such that a magnetic field may be created within the center of coil 22 by passing a current in either direction through the coil 22. The magnetic field produced by coil 22 may either align with or oppose the lines of force extending from the north pole 17 of permanent bar magnetic 20 to its south pole 19. In the arrangement illustrated in FIG. 2, a direct current entering the first lead 24 of the solenoid coil 22 would produce a magnetic field having lines of force which would correspond to the lines of force flowing from the north pole 17 of the bar magnetic 20 to its south pole 19. Similarly, a direct current entering the second lead 26 and flowing in the opposite direction through coil 22 would produce an oppositely directed magnetic field to cause the magnetic display element 14 to be realigned so that its hemispherical surfaces 16 and 18 would be oriented opposite to that shown.

Figure 3:
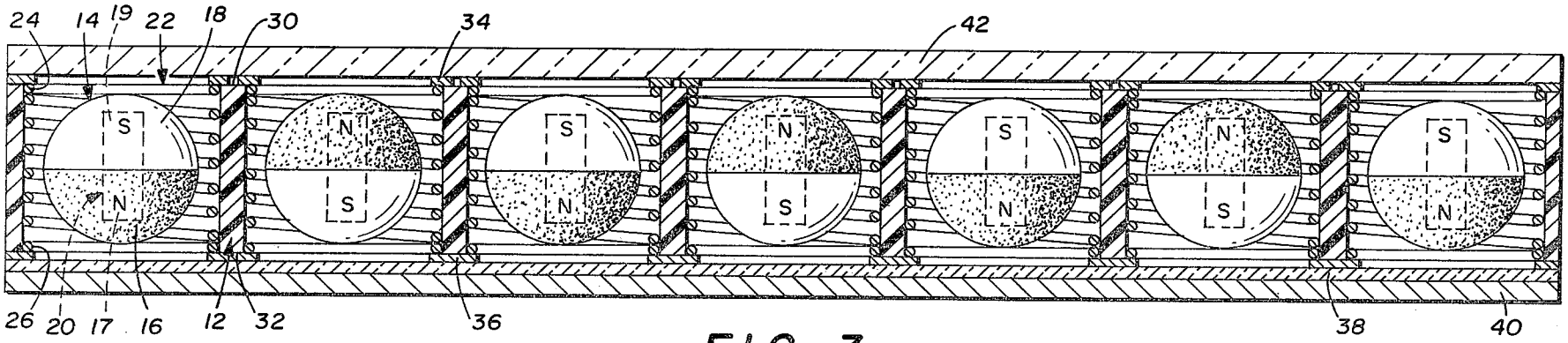
FIG. 3 is a cross-sectional side view of a row of display elements within a display board.

FIG. 3 is a cross-sectional view of the row of display elements taken along the line 3—3 in FIG. 1. The display board 12 has a row of seven holes 28 formed completely therethrough for receiving therein the solenoid coils 22. This display board 12 has a front surface 30 which is colored the same as the colored hemispherical surface 18 of the magnetic display element 14. Display board 12 also has a rear surface 32 which is obviously not seen by the viewer facing the front surface 30. Further, the display board 12 is of a height 33 which is at least equal to the diameter 35 of the display element 14. In order to have a compact information display system 10 the display boards 12 should have a minimum height 33. A typical system 10 of the present invention may be constructed with a display board 14 as a stock printed circuit board with a height 33 of only three millimeters.

A first printed circuit track 34 on the front surface 30 electrically connects the first leads 24 of the solenoid coils 22 aligned in a column of the display board 12. Similarly, a second printed circuit track 36 on the rear surface 32 electrically interconnects the second leads 26 of the solenoid coils 22 aligned in a row of the display board 12.

A thin layer of insulator type material 38 is disposed adjacent the rear surface 32 and the printed circuit track 36, such that the printed circuit track 36 is electrically insulated from a ferromagnetic back plate 40 positioned beneath the rear surface 32 of the display board 12. The ferromagnetic back plate 40 acts to latch the magnetic display element 14 in either one of its aligned states as determined by the magnetic field within the solenoid coil 22. A transparent cover sheet 42 is shown adjacent the front surface 30 of the magnetic display board 12 and the printed circuit track 34 for retaining the magnetic display elements 14 within their holes 28 while allowing a view of the colored hemispherical surfaces 16 or 18 of the aligned magnetic display elements 14.

Figure 5:
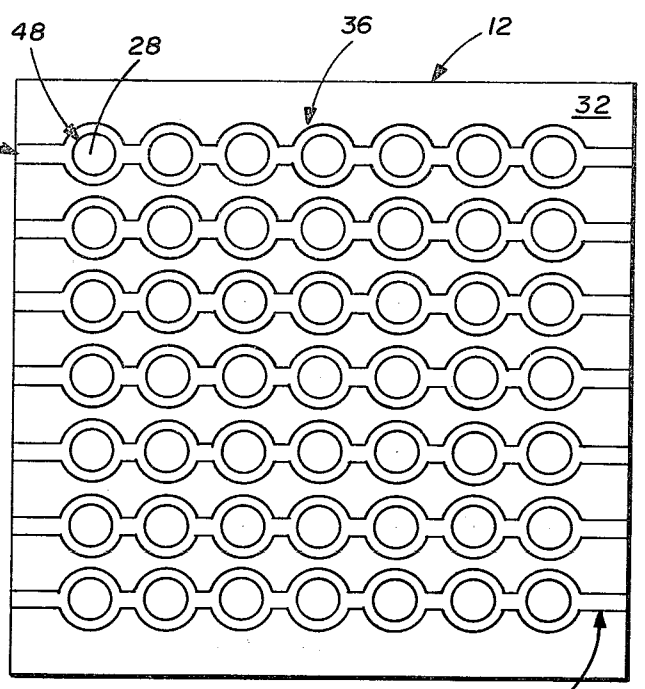
FIG. 5 is a rear view of the printed circuit track on the rear side of the printed circuit board.
Figure 4:
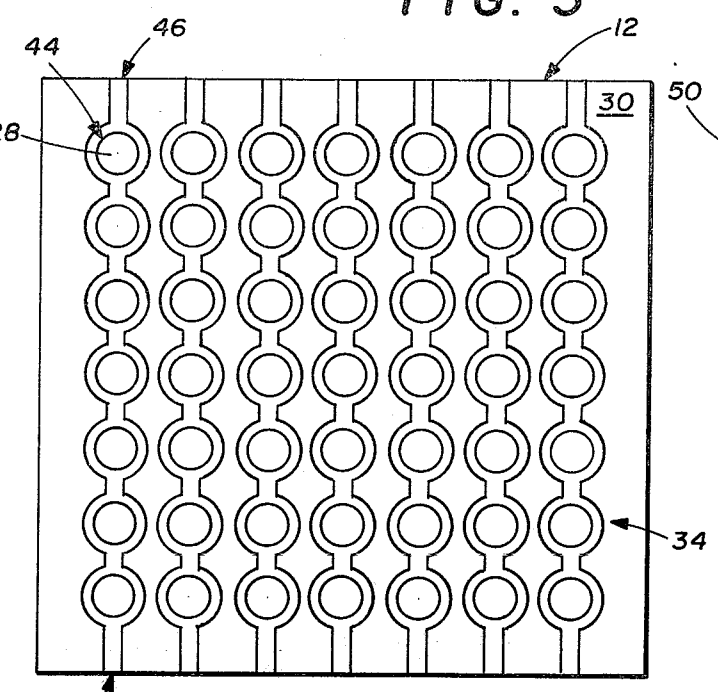
FIG. 4 is a front view of the printed circuit track on the front side of the printed circuit board.

FIGS. 4 and 5 illustrate the front surface 30 and the rear surface 32 of a display board 12, respectively. All of the solenoid coils 22 (not shown) in one of the seven columns of the display board 12 are electrically interconnected by the first printed circuit track 34 on the front surface 30 of the display board 12. Printed circuit track 34 includes an annular ring 44 formed about each hole 28 for providing electrical contact with the first lead 24 of the solenoid coil 22. The annular ring 44 of the printed circuit track 34 is interconnected in columnar fashion and includes leads 46 for connecting the coils to a first set of digital drivers 54 (shown in FIG. 6).

Similarly, the rear surface 32 illustrates the second printed circuit track 36 for electrically interconnecting the solenoid coils 22 disposed within a row of the display board 12. The printed circuit track 36 includes annular rings 48 formed about the holes 28 on the rear surface 32 of display board 12 for forming an electrical connection with the second lead 26 of solenoid coil 22. The annular rings 48 aligned in a row are interconnected and are provided with suitable leads 50 connected to a second set of digital strobes 64 (shown in FIG. 6).

Figure 6:
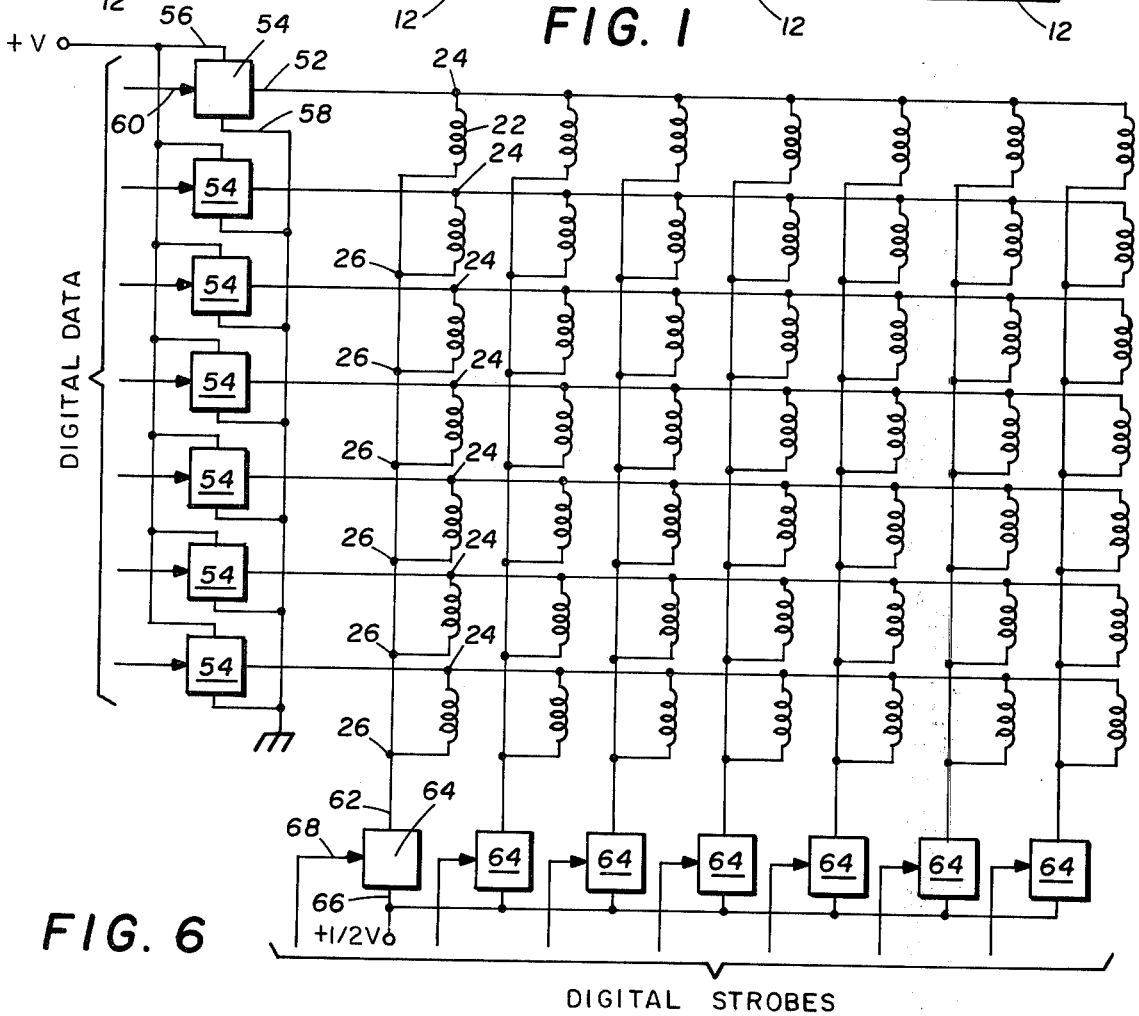
FIG. 6 is a schematic diagram of the preferred embodiment of the invention.

FIG. 6 is a schematic illustration of the electrical interconnection of the solenoid coils 22 within a typical display board 12. The first leads 24 of the coils 22 are interconnected in columnar fashion and driven by the output 52 of digital drivers 54. Terminals 56 of the digital drivers 54 are provided with a reference source of voltage "+V" and have their ground terminals 58 connected to a common ground. The output signal of a digital driver 54 is determined by the input signal received at its input terminal 60. Thus, if the input logic is either a logic "0" or logic "1" at the terminal 60, the driver 54 has an output of approximately ground or "+V", respectively.

The second lead 26 of the solenoid coils 22 aligned in a row are electrically interconnected on the rear surface 32 of the display board 12 to an output terminal 62 of a set of digital strobes 64. The strobes 64 have their input terminals 66 connected to a voltage source equal to one-half that of the reference voltage "+V" for the set of drivers 54. A digital strobe 64 may be strobed for a short period of time with a "+½ V" voltage at its terminal 68 to cause current to flow through the coil that intersects that row and column in a direction determined by the voltage at the opposite lead 24 of the coil 22 to set the element 14 in the desired orientation. For example, if the row is strobed with the "+½ V" and the column is at ground potential, the current will flow from the second lead 26 to the first lead 24, and if the column is at "+V" potential when the row is strobed current will flow in the opposite direction. The coils 22 may be pulsed with such a current for a short period of time, e.g., a small fraction of a second. Thus, the resultant magnetic field produced by the coils 22 may be selectively controlled by such techniques to cause the display elements 14 to be selectively aligned to convey the desired information.

The ferromagnetic back plate 40 provides a path for the lines of force flowing from the bar magnet 20 to keep the display element 14 aligned in the position determined by the last magnetic field produced within that particular coil 22. Thus, the information display system 10 of the present invention consumes no quiescent power and retains the information last displayed in the event of a power failure.

Figure 7:
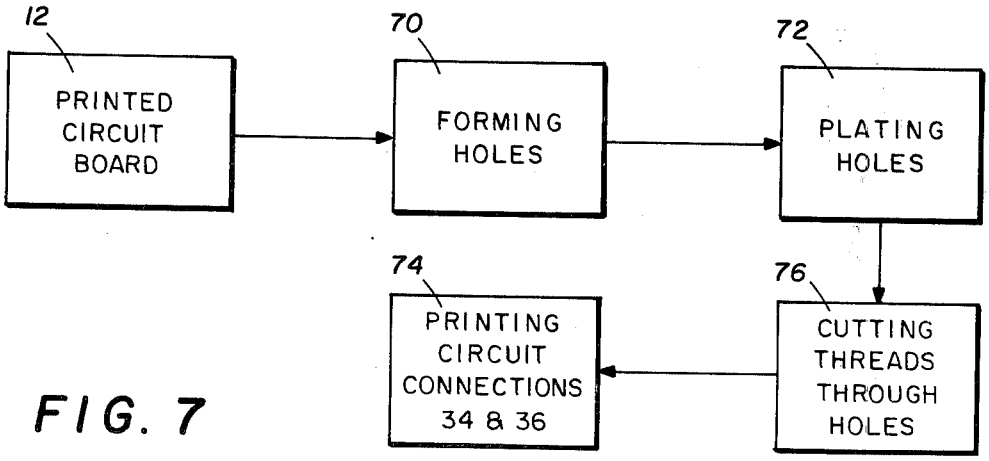
FIG. 7 is a block diagram of the preferred embodiment for assembling the solenoid coils of the present invention.

The solenoid coils 22 of the information display system 10 may be assembled in situ by an improved method of the present invention, as illustrated in FIG. 7. The display board 12 as previously indicated may comprise a suitable piece of stock printed circuit board having the desired height 33 equal to or greater than the diameter 35 of the display elements 14. As shown in block 70, holes 20 may then be formed through the display board 12 by any suitable means such as drilling. The holes 20 may be plated around their inside surfaces with a suitable electrical conductor, e.g., aluminum, as shown in block 72. In the next step shown in block 74, the solenoid coils 22 may be formed by using a very fine machine screw tap to cut threads through the plating, thereby forming a coil. Finally, the printed circuit tracks 34 and 36 could be formed in the normal printed circuit fashion in one operation 76.

In operation, conventional row or column scan display multiplexing techniques as described above can be used to arrange the magnetic display elements 14 in any desired pattern within the display board 12. For example, in the first display boards 12 in FIG. 1, the letter "L" is displayed therein. This display may be achieved by inputting a logic "1" at the terminals 60 of those digital drivers 54 connected to the first leads 24 of all solenoid coils 22 in column 2 and only those coils 22 in columns 3, 4, 5 and 6 in the seventh row of the display board 12. The remaining digital drivers 54 have a logic "0" state at terminal 60. Thus a "+V" voltage is present at the terminals 24 of all solenoid coils 22 in column 2 and the coils 22 in columns 3, 4, 5 and 6 of the seventh row. The remaining solenoid coils 22 have a voltage equal to approximately ground at their terminals 24.

Next, strobing each of the seven rows of coils 22 with a "+½ V" voltage from the digital strobes 64 turning on for a small fraction of a second causes current to flow through the coil 22 in the direction necessary to produce the information shown displayed in FIG. 1. The ferromagnetic back plate 40 latches the display elements 14 into the alignment set by the drivers 54 and the strobes 64 when the drivers are turned off. The dark contrastingly colored hemispherical surfaces 16 corresponding to the north pole of permanent bar magnetics 20 contrast with the background of front surface 30 of the display board 12 to visually indicate the desired information. Therefore, by a mass printed circuit production technique, multiplexing, and by strobing the display with a "+½ V" reference voltage, an information display system 10 can be designed for battery operated, field portable information display equipment.

The information display system 10 of the present invention is capable of displaying information without consuming quiescent power, operating over a wide temperature range and displaying the information in direct sunlight as well as in total darkness. In addition, the information display system 10 is compact, consisting of a flat printed circuit board panel which may be, for example, 3mm thick. Since the information display system 10 of the present invention does not consume any quiescent power, the information that is displayed at any particular instant will not be lost if the system's power supply fails.

Although preferred embodiments of the invention have been illustrated in the accompanying drawings and described in the foregoing description, it will be understood that the invention is not limited to the embodiments disclosed, they are capable of numerous rearrangements, modifications, and substitutions of parts and elements without departing from the spirit of the invention. For example, instead of being arranged in a matrix of columns and rows, the display holes may be arranged in any predetermined order to convey the desired information by selectively inducing a directional magnetic field through the solenoid coils.

What is claimed is:

1. An electromagnetic information display system comprising:

a plurality of permanently magnetized spheres having uniform contrastingly colored hemispheres associated with the magnetic poles of each of said spheres, a printed circuit board having a thickness at least as great as the diameter of said spheres, said board further having a plurality of cylindrical holes formed therethrough and arranged in a matrix of columns and rows for receiving said plurality of permanently magnetized spheres, a plurality of solenoid coils, one of said plurality of solenoid coils being positioned within each one of said cylindrical holes to selectively position said sphere within said cylindrical hole, means for electrically interconnecting a first lead of each of said coils in a column and a second lead of each of said coils in a row, a panel extending across the back side of said printed circuit board for insulating said printed circuit board, a ferromagnetic back plate extending across the back of said insulated panel for magnetically retaining the alignment of said spheres with the axis of their magnetic poles normal to said back plate, a plurality of digital drivers connected to the columns of the matrix of solenoid coils to output a ground or positive voltage corresponding to the input logic state of said drivers, and a plurality of digital strobes connected to the rows of the matrix of solenoid coils for strobing said coils with a voltage one-half that of the reference voltage, such that the current flowing through said coils and the directional magnetic fields produced thereby may be selectively reversed to cause said spheres to align themselves in a pattern determined by said digital drivers and said digital strobes to display the desired information.

2. The electromagnetic information display system of claim 1 wherein said means for electrically interconnecting said coils comprises:

an electrical conductor printed on the front surface of said display board for connecting said first leads of all said coils within a column; and an electrical conductor printed on the rear surface of said display board for connecting said second leads of all said coils within a row.

3. An electromagnetic information display system comprising:

a printed circuit board having front and rear surfaces and a matrix of columns and rows of holes formed therethrough;

a plurality of solenoid coils, one of said plurality of solenoid coils being disposed within each one of said holes, said solenoid coils being electrically interconnected by having one lead of each coil electrically connected by a printed conductor on said front surface of said circuit board to a corresponding lead of other coils within each of said columns and the opposite lead of each coil electrically connected by a printed conductor on said rear surface of said printed circuit board to the leads of other coils within each of said rows;

a plurality of permanently magnetized spheres having contrastingly colored hemispherical surfaces corresponding to the magnetic poles of the hemispheres, each sphere being positioned within one of said solenoid coils within one of said printed circuit board holes;

a ferromagnetic back plate for latching said permanently magnetized spheres with the axis of the magnetic poles normal to the surface of said back plate;

a layer of insulation positioned adjacent the rear surface of said printed circuit board for electrically insulating said printed conductor on said rear surface of said printed circuit board from said back plate, a transparent cover sheet positioned over the front surface of said printed circuit board such that said spheres are visibly retained within said solenoid coils, a plurality of digital drivers, each of said drivers having its output connected to said solenoid coils interconnected in a column for selectively outputting either a ground or a predetermined positive reference voltage corresponding to the input of said driver, and a plurality of digital strobes, each of said strobes having its output connected to said solenoid coils interconnected in a row for selectively strobing an output voltage equal to one-half the reference voltage, such that said drivers and said strobes selectively induce a reversible magnetic field within each of said solenoid cells for collectively arranging the spheres within said coils for displaying information upon said printed circuit board.

* * * * *